US005878904A

United States Patent [19]

Schweigert

[11] Patent Number: 5,878,904

[45] Date of Patent: Mar. 9, 1999

[54] TRASH CAN DIVIDER FOR RECYCLABLE MATERIALS

[76] Inventor: Jeffrey J. Schweigert, 5739 Juneau La., Plymouth, Minn. 55446

[21] Appl. No.: 634,587

[22] Filed: Apr. 18, 1996

[51] Int. Cl.[6] ..... B65F 1/08

[52] U.S. Cl. ..... 220/23.88; 220/23.4; 220/908.1; 220/909; 220/23.86

[58] Field of Search ..... 220/23.4, 23.83, 220/23.86, 909, 408, 410, 23.2, 908.1, 23.91, 23.9, 23.88, 23.87, 4.27, 4.26; 206/514

[56] References Cited

U.S. PATENT DOCUMENTS

| | | | |
|---|---|---|---|
| 193,479 | 7/1877 | Burgin | 220/23.4 |
| 3,648,875 | 3/1972 | Lundgren | 220/23.4 |
| 3,904,218 | 9/1975 | Kostic | 220/23.4 |
| 4,834,253 | 5/1989 | Crine | 220/1 T |
| 4,878,592 | 11/1989 | Lee | 220/909 |
| 4,988,010 | 1/1991 | Pollak | 220/23.83 |
| 5,011,026 | 4/1991 | Hausman et al. | 209/675 |
| 5,062,540 | 11/1991 | Jenkins | 220/23.4 |
| 5,096,086 | 3/1992 | Crema | 220/533 |
| 5,101,997 | 4/1992 | Bagwell et al. | 220/23.4 |
| 5,143,246 | 9/1992 | Johnson et al. | 220/909 |
| 5,183,278 | 2/1993 | Wade, Jr. | 280/47.35 |
| 5,188,254 | 2/1993 | Evans | 220/404 |
| 5,190,183 | 3/1993 | McNaughton et al. | 220/551 |
| 5,193,713 | 3/1993 | Greathouse et al. | 220/528 |
| 5,558,254 | 9/1996 | Anderson et al. | 220/909 |

FOREIGN PATENT DOCUMENTS

| | | | |
|---|---|---|---|
| 3524781 | 1/1987 | Germany | 220/909 |
| 539483 | 9/1941 | United Kingdom | 220/909 |
| 1533841 | 11/1978 | United Kingdom | 220/909 |

OTHER PUBLICATIONS

Consolidated Plastics Company, Inc., *Rubbermaid® Catalog*, pp. 14–15 (1995).

Page from *Hold Everything* catalog (Feb. 1995).

Page entitled "Recycling at Home–Kitchen", p. 211 (author, publication, and date unknown).

*Primary Examiner*—Stephen Castellano

*Attorney, Agent, or Firm*—Merchant, Gould, Smith, Edell, Welter & Schmidt, P.A.

[57] ABSTRACT

An apparatus for dividing a trash can into a plurality of separate compartments for separating and storing recyclable materials. The plurality of separate compartments are formed by placing a plurality of insertable dividers into the trash can. The dividers combine to define an aperture in the center of the trash can opening to a lower volume of the trash can, permitting the disposal of metal cans or some other material into the lower volume.

14 Claims, 9 Drawing Sheets

TRASH CAN DIVIDER FOR RECYCLABLE MATERIALS

BACKGROUND

During recent years, interest in recycling of household waste has steadily increased. This interest has been fueled by increasing problems of solid waste removal and disposal. Communities have looked to recycling to handle their garbage as old landfills become full and new landfills are not built. In addition, recycling saves energy and raw materials, thereby helping to preserve the environment.

The most commonly recycled household materials are glass, aluminum, metals, plastics and paper. Many municipalities either encourage or require the removal of these materials from the waste stream. However it is also necessary to separate these materials according to the type of recyclable material. Glass, paper, plastics, and metals must all normally be separated from one another. This separation step is necessary to allow for efficient processing of the recycled materials, and materials which are not separated are often refused for recycling.

Previously, most parties involved in recycling have used separate containers for sorting and storing each type of recyclable material. For example, one container is typically used for glass, one container is typically used for metals, and one container is typically used for paper. Unfortunately, use of separate containers requires substantial space, and is thus impractical and inconvenient for many people and businesses. The use of multiple containers also requires making multiple trips to set out the recyclables for pickup, unless all of the containers can somehow be carried in one trip. Additionally, it can be expensive to purchase numerous containers.

Efforts have been made to address this problem, but they have been largely ineffective. For example, stackable bins have been introduced as a way to separate recyclables without occupying extensive floor space. However these bins have the shortcoming of limited storage space and require a front or top opening, which often reduces the volume of recyclables each bin can store. Also, the bins are awkward to carry in groups to a recyclable pickup location, such as an alley or at the end of a driveway, because they are stacked and unstable. Other efforts have also been made to create separate containers for recyclable materials, but these efforts also have shortcomings. For example, U.S. Pat. No. 5,193,713 to Greathouse, et al, involves modifying the top of a garbage can to hold a plurality of garbage bags. However, the Greathouse design is awkward to use because it requires constant replacement of garbage bags. It is also prone to failure since the recyclables can become intermixed if the bags slip from their holders.

Accordingly, there is a need for an improved recyclables container into which a plurality of separated recyclable articles may be placed.

SUMMARY OF THE INVENTION

The present invention is directed to a trash can divider for dividing a trash can so that different types of recyclable materials may be separated and stored. When a plurality of the trash can dividers are placed within a trash can, they define an aperture in the center of the trash can opening to a lower portion of the trash can. This aperture can be used to drop aluminum cans or other recyclable materials into the bottom of the trash can.

A cover may be placed over the top of a plurality of trash can dividers. This cover may be one which fits the original trash can, or it may be a unique shape and size suitable for use only with the dividers. Each divider further includes a handle, preferably placed on the outer wall, for use in removing the divider from the trash can and for carrying the divider. Each divider also preferably includes a lip portion supporting the divider on a top edge of the trash can.

The trash can dividers are preferably tapered so that they may be nested together. Nesting dividers are advantageous because they permit compact storage of the dividers when not in use, for shipping, and for retail display.

The trash can divider of the present invention is preferably constructed of a one-piece molded plastic material, however numerous alternative manufacturing techniques and materials are also envisioned.

It should be noted that the term "trash can divider", as used in this patent, is broadly defined to cover a divider for numerous different types of containers, not just trash cans. For example, the "trash can" may be an actual trash can, a recycling bin, a barrel, a frame, a box, or a container made specifically for the purpose of retaining the can dividers.

Also, while the preferred embodiment of the present invention is described for use in the context of separating recyclable materials, it should be noted that the present invention will find application in numerous other situations where separation and sorting is desired.

BRIEF DESCRIPTION OF THE DRAWINGS

A more complete understanding of the invention may be had by reference to the following detailed description when taken in conjunction with the accompanying drawings, in which.

DETAILED DESCRIPTION

Figure 1:
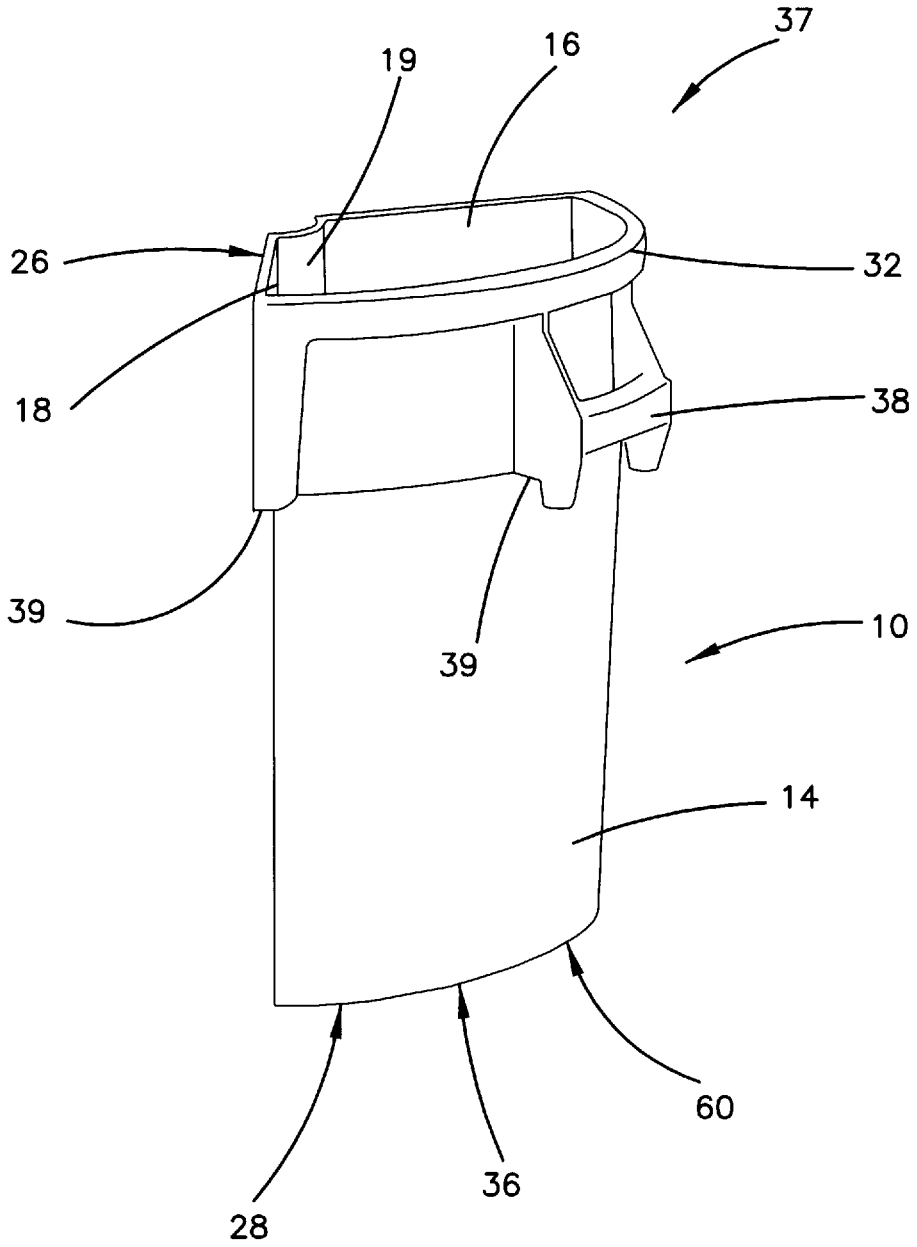
FIG. 1 is a perspective view illustrating an embodiment of a trash can divider in accordance with the principles of the invention.

Referring now to the drawings, wherein like reference numerals designate corresponding structure throughout the views, and referring in particular to FIGS. 1 through 4, there is shown a trash can divider, generally designated 10, for dividing a trash can 12. During normal use, a plurality of trash can dividers 10 are placed in each trash can 12. The plurality of trash can dividers 12 define an aperture 40 proximate the center of the trash can 12. This aperture 40 provides access from the top 42 of the trash can 12 to a bottom volume 56. The bottom volume 56 of the trash can 12 may be used to store an additional recyclable material. Alternatively, the bottom volume 56 of the trash can 12 may be used to deposit unrecycleable trash for disposal.

In the preferred embodiment, each trash can divider 10 includes at least three distinct walls: a first wall 14 generally conforming to a portion of the interior surface of the trash can 10 and a second wall 16 and third wall 18 connected to opposite edges of the first wall 14 and projecting into the interior of the trash can 12. The second wall 16 and third wall 18 converge toward one another. In the preferred embodiment, the second wall 16 and third wall 18 are connected to each other by an additional wall 19. When a plurality of dividers 10 are placed together, the additional walls 19 combine to form the aperture 40. In the preferred embodiment, a cylindrical base is formed, however other configurations of apertures might be formed in alternative embodiments.

Figure 9:
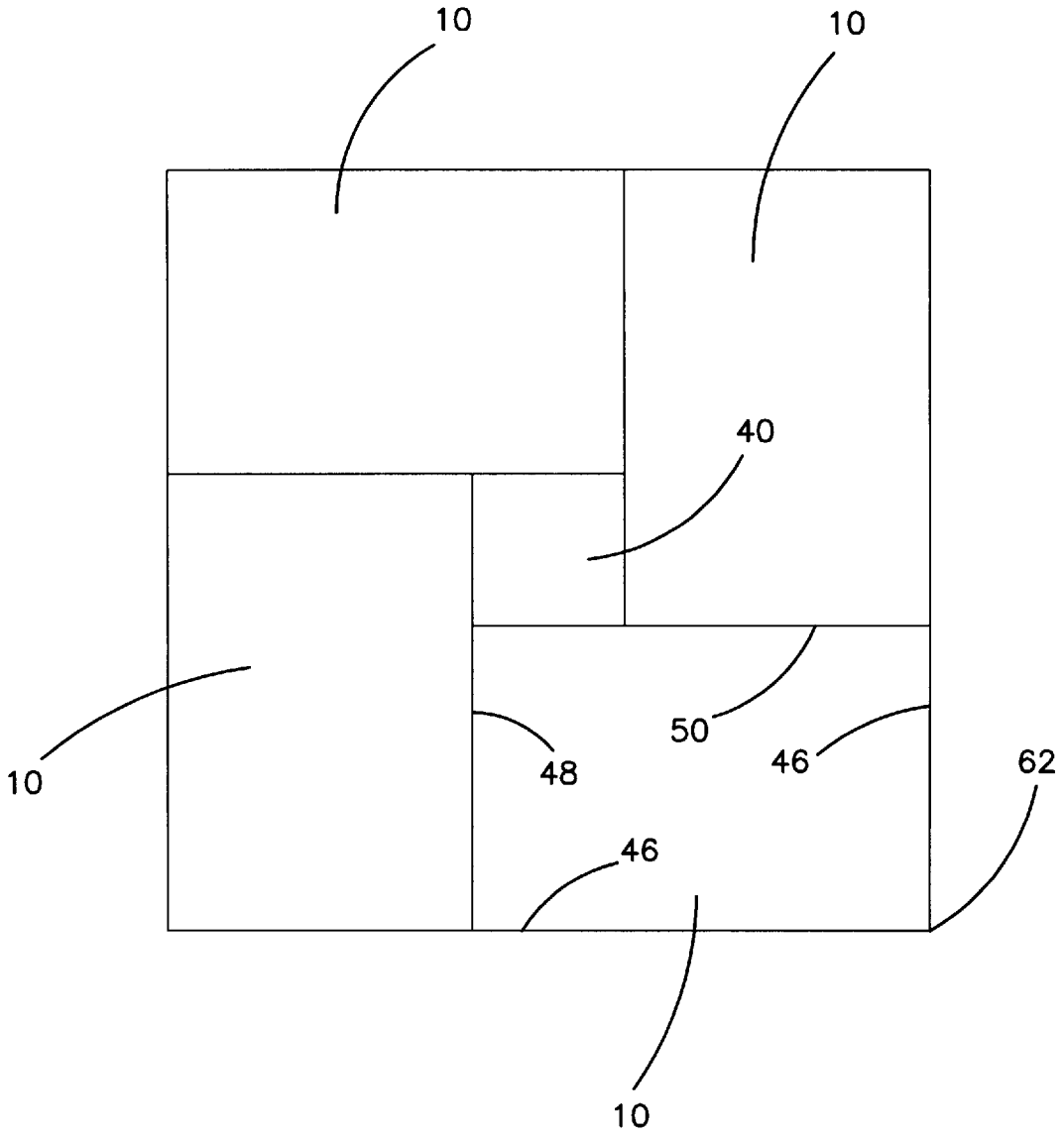
FIG. 9 is a diagrammatic view of an alternative embodiment wherein four rectangular trash can dividers define a center aperture.

Alternatively, the second wall 16 and the third wall 18 may be connected to opposing edges of the first wall 14 and to each other. In such an embodiment, an additional wall is not located between the second wall 16 and third wall 18. Still, when a plurality of trash can dividers 10 is placed within a trash can 12, they define an aperture 40 leading to the bottom 42 of the trash can 12. For example, as shown in FIG. 9, the trash can dividers 10 may have a rectangular horizontal cross-section. A first wall 46, containing an approximately 90 degree corner 62 near its midpoint, is joined at opposite edges to a second wall 48 and a third wall 50. The second wall 48 and third wall 50 join together at edge 52. When a plurality of identical rectangular trash can dividers 10 are placed within a square trash can 12, they cooperate to define a central aperture 40.

It is imagined that the trash can 12 may be any of numerous different types of containers and is not limited to an actual trash can. Thus, barrels, boxes, bins, frames, or containers manufactured specifically for the purpose of retaining the dividers may be used as a "trash can". The trash can dividers 10 may be manufactured in a variety of sizes depending upon the desired capacity and application. For example, the trash can divider 10 and trash can 12 can be sized to fit beneath a kitchen sink or inside a closet. The trash can dividers 10 may also be sized to fit inside standard trash cans 12.

Figure 2:
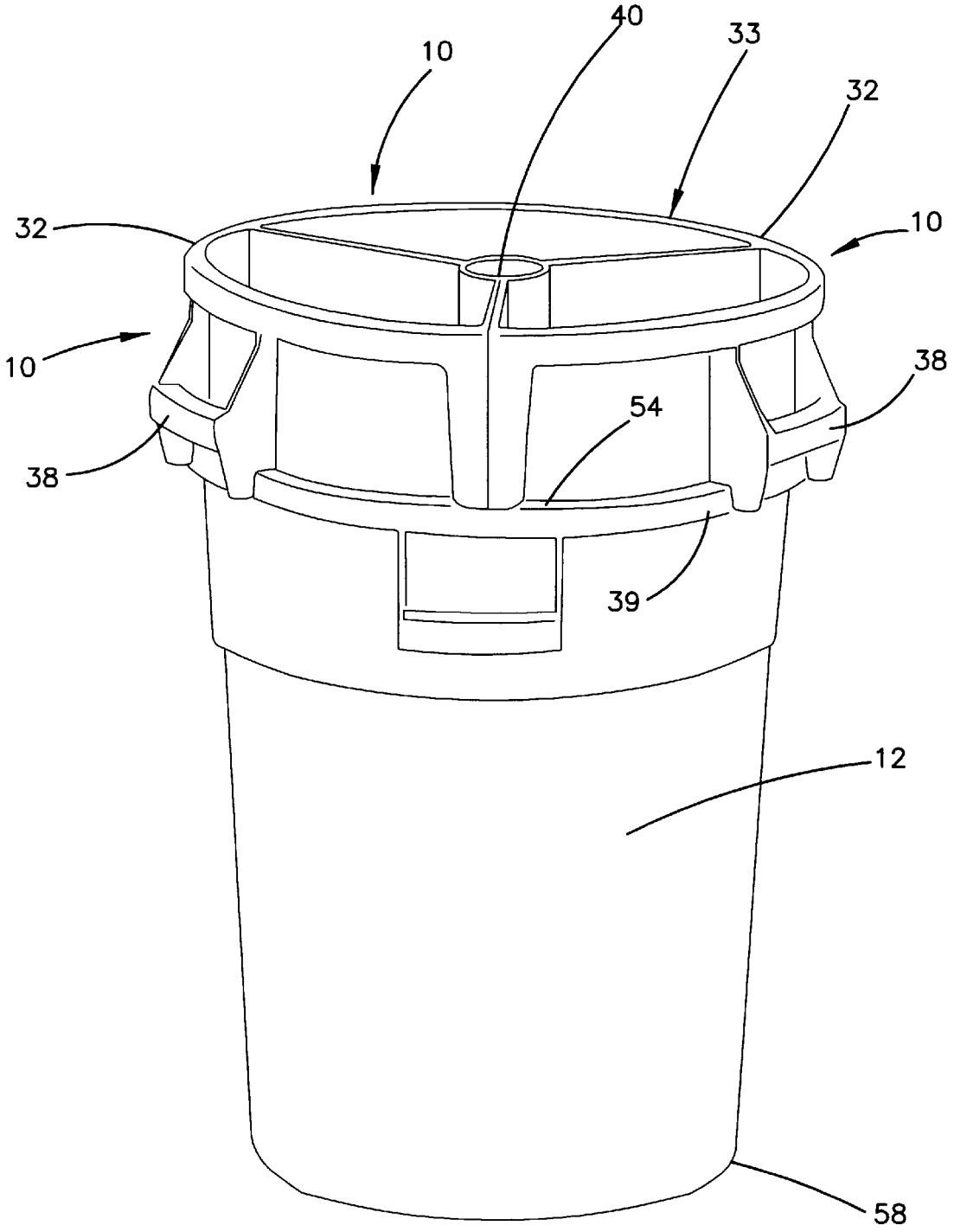
FIG. 2 is a perspective view of three of the trash can dividers shown in FIG. 1 inserted into a trash can.
Figure 3:
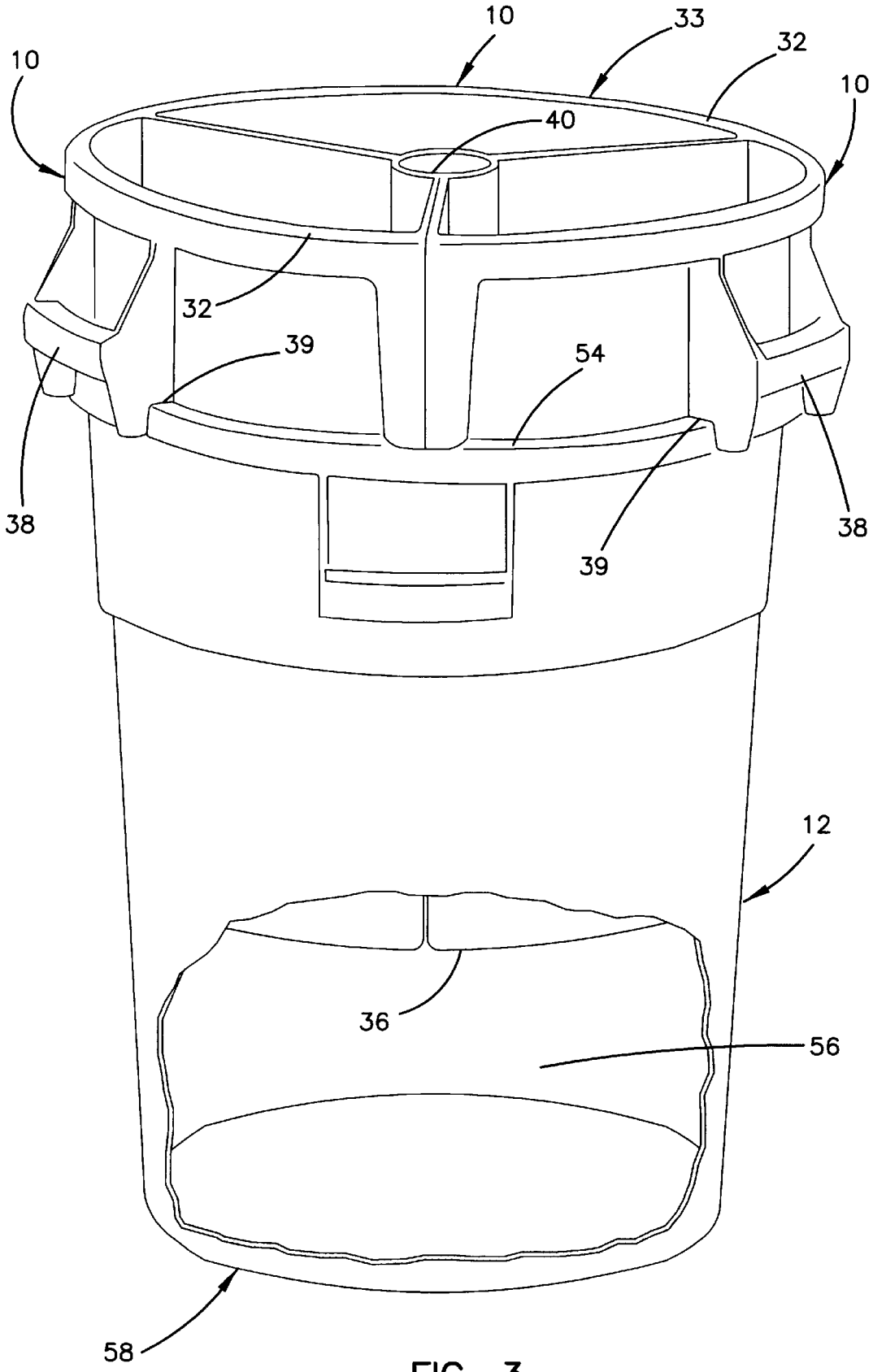
FIG. 3 is a perspective view of three of the trash can dividers shown in FIG. 1 inserted into a trash can (2), and further showing a cut-away view of the bottom of the trash can.

Referring to FIGS. 1, 2 and 3, it can be seen that each trash can divider 10 preferably includes a handle 38. The handle 38 is preferably placed on the outside surface of the first wall 14, and is useful for removing the divider from the trash can and for carrying the divider. Alternatively, the handle 38 may be configured as an opening into the first wall 14, into which a hand is placed when removing the divider 10 from the trash can 12.

Referring to FIGS. 1 through 6, each trash can divider 10 preferably includes a lip portion 39 configured for supporting the divider 10 on a top edge 54 of the trash can 12. This lip portion 39 keeps the divider 10 from falling into the trash can 12 when other dividers 10 are removed, and maintains the dividers 10 at a pre-selected height above the bottom 58 of the trash can 12. The lip portion 39 may be integrated into the handle 38, may be an overhanging portion of the first wall 14, or may be a totally separate ridge in the first wall 14. In the preferred embodiment, the length of the divider 10 from the lip portion 39 to the bottom edge 36 is less than the height of the trash can 12. Therefore, the volume 56 below the dividers 10 is determined by the length of the dividers 10 below the lip portion 39 and the height of the trash can 12.

Figure 6:
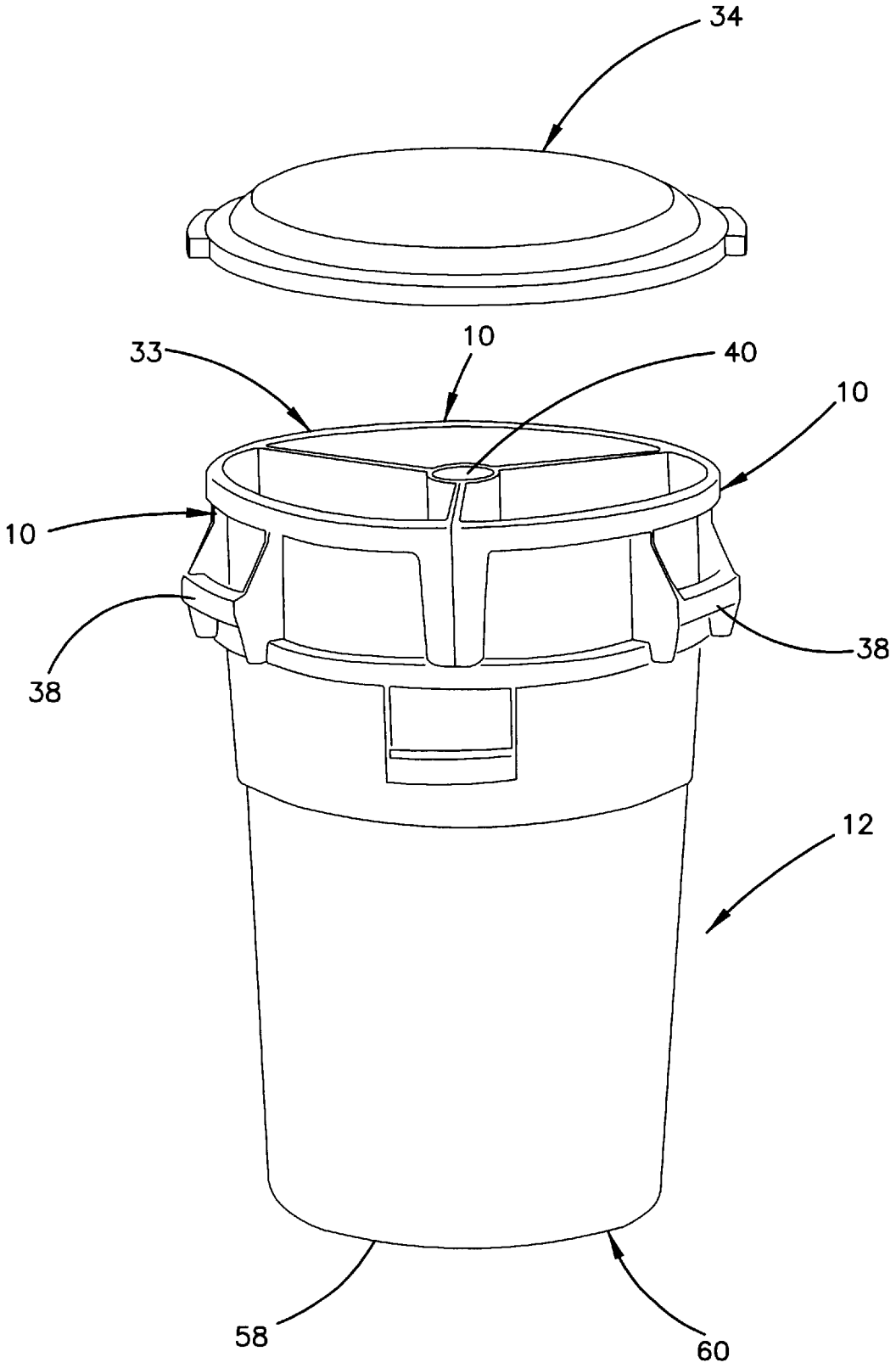
FIG. 6 is an exploded perspective view illustrating the three trash can dividers inserted into a trash can, and a cover for the trash can dividers.
Figure 7:
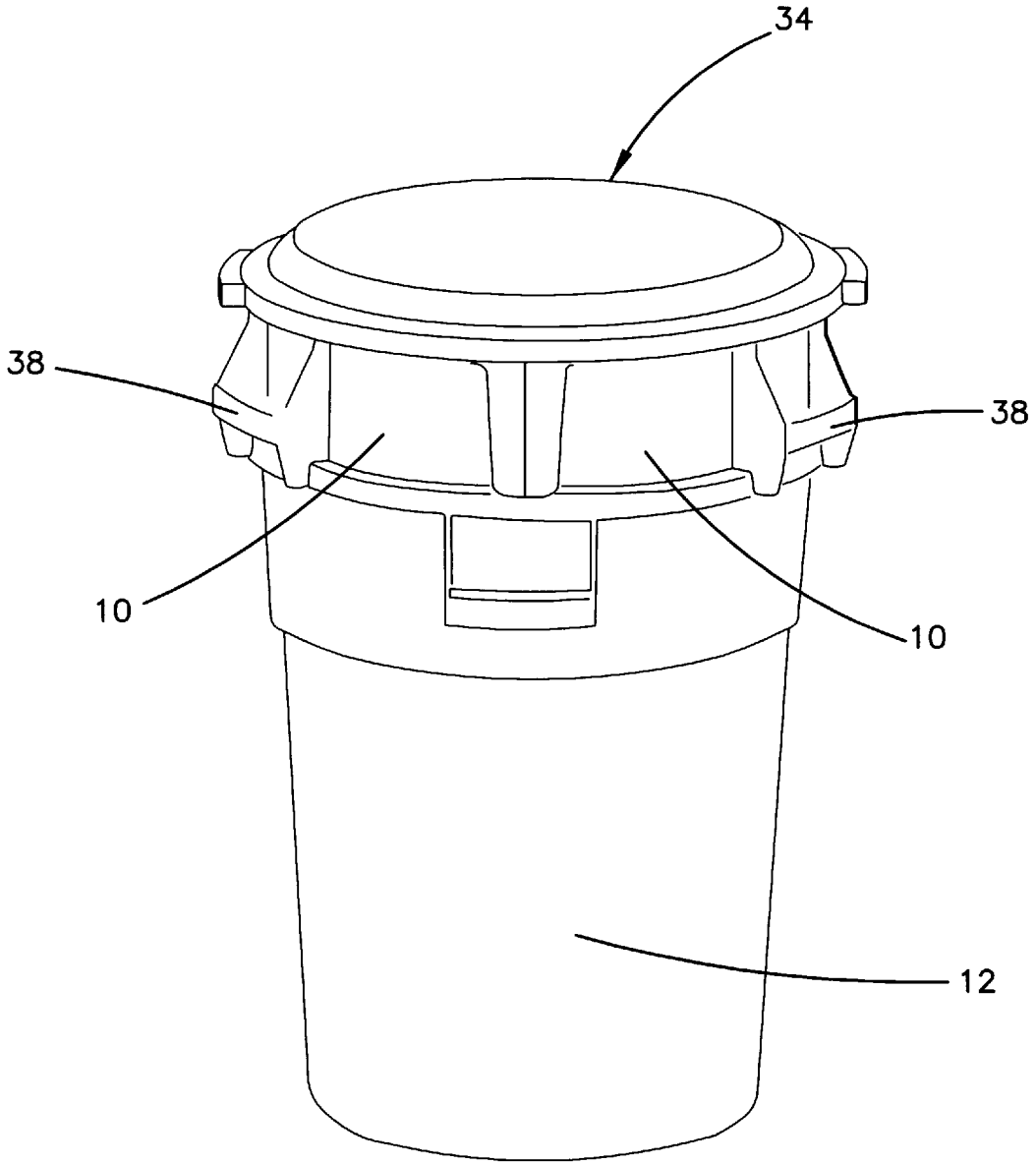
FIG. 7 is a perspective view illustrating the three trash can dividers inserted into a trash can and enclosed by the cover.

The upper edge 32 of the first walls 14 of a plurality of trash can dividers 10 defines a ridge 33 for receiving a lid 34 as depicted in FIGS. 6 and 7. This ridge 33 may be configured to receive a lid 34 originally suited for covering the trash can 12. Alternatively, the ridge 33 may be configured for receiving a lid 34 manufactured specifically for covering the trash can dividers 10. The lid 34 may be configured to cover all of the dividers 10 at one time, or to cover only a portion of the dividers 10.

Figure 8:
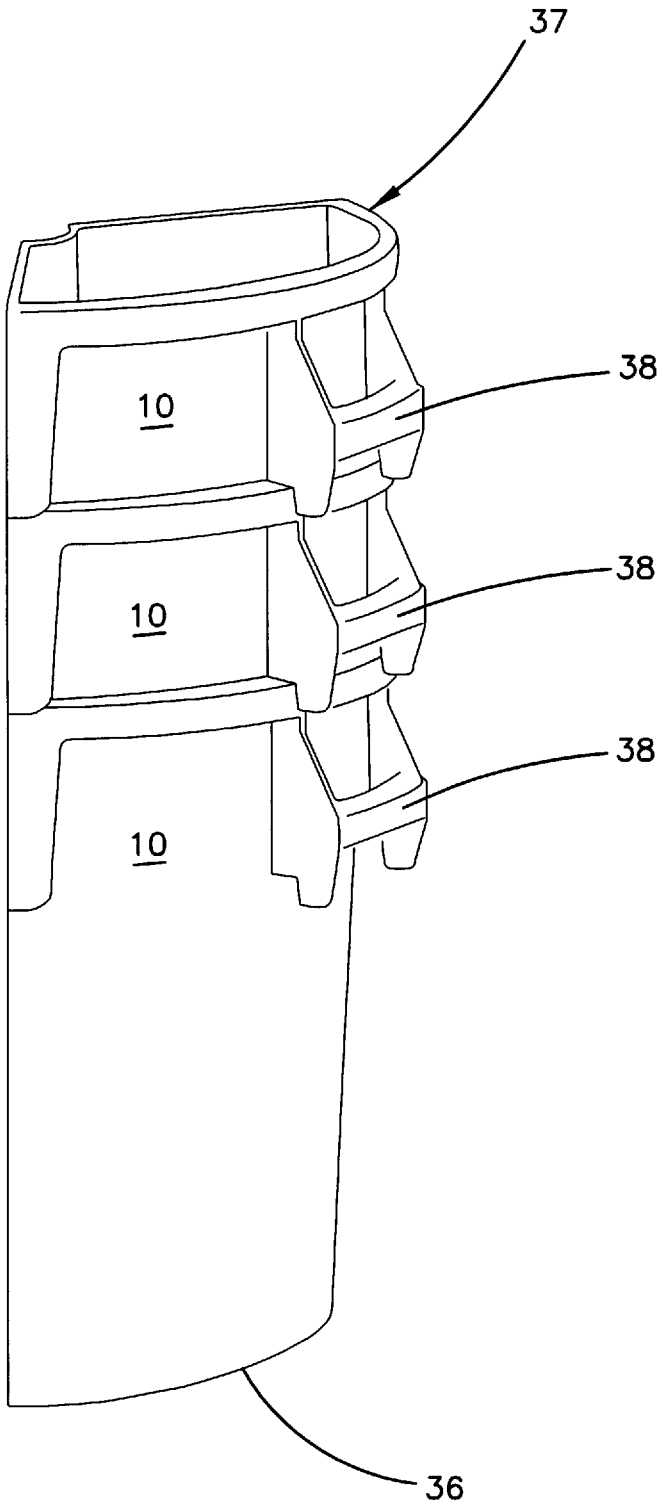
FIG. 8 is a perspective view showing three trash can dividers inserted into one another (nested) for compact storage.

Referring to FIG. 8, the trash can dividers 10 preferably have a tapered form such that the bottom 36 is narrower than the top 37 so as to permit nesting of multiple dividers 10 together.

When the trash can dividers 10 are filled to a desired level, the dividers 10 are lifted from the trash can 12. The remaining trash can dividers 10 may be left inside the trash can while other dividers are removed. The remaining dividers are retained on the trash can 12 by the lip portion 39. Once emptied, the divider 10 is easily reinserted downwardly into the trash can 12.

Figure 4:
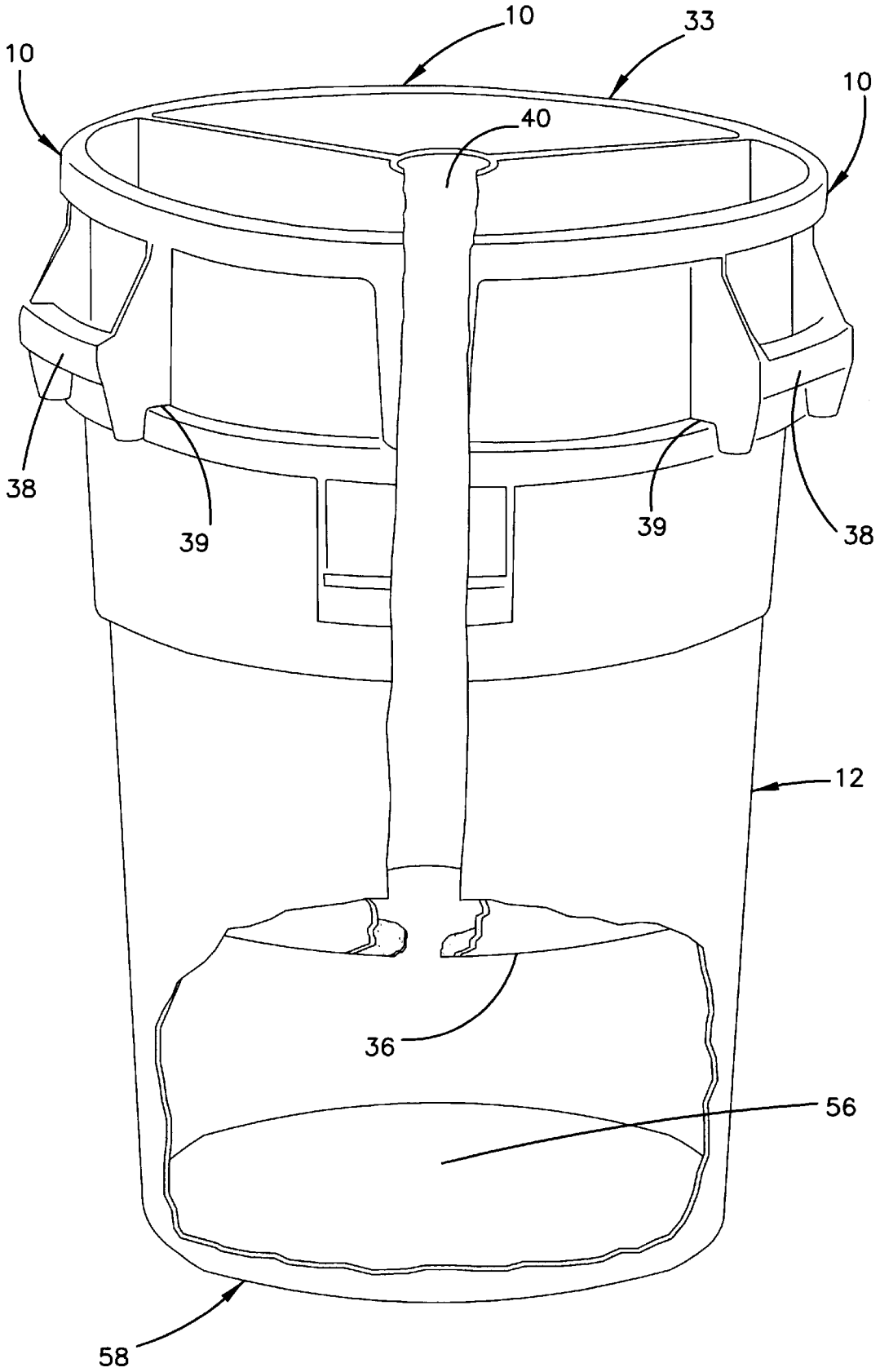
FIG. 4 is a perspective view of three of the trash can dividers shown in FIG. 1 inserted into a trash can (2), and further showing a cut-away view of the aperture formed by the containers and of the bottom of the trash can.
Figure 5:
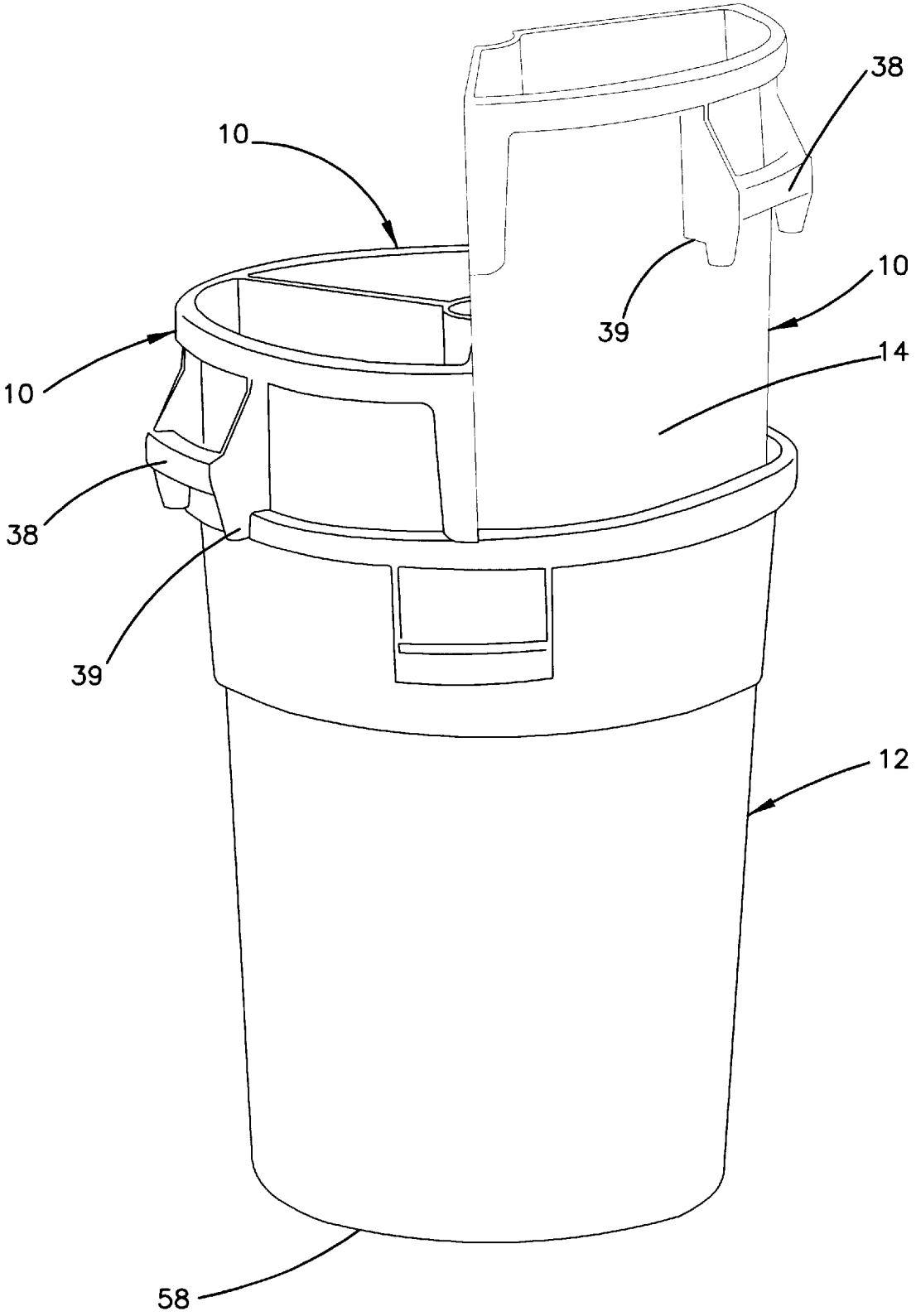
FIG. 5 is a perspective view illustrating partial removal of one of the trash can dividers shown in FIG. 2.

Each of the trash can dividers 10 used in a trash can 12 may be of unequal sizes. FIGS. 2, 3, and 4 show the dividers 10 each comprising approximately one-third of the trash can 12. However, the dividers 10 may be sized differently in order to accommodate differing quantities of the various types of materials discarded by a household. If, for example, a household disposes of substantially more paper than glass, then a larger divider 10 could be provided and used to collect discarded paper, while a smaller divider 10 would be used to collect discarded glass.

The preferred embodiment discloses a trash can divider 10 having a generally pie-shaped horizontal cross-section. When a plurality of generally pie-shaped dividers 10 are placed together, they define a generally circular shape. However, rectangular, triangular, or other shapes are also envisioned.

Each trash can divider 10 may include a generally flat bottom surface 60 suitable for supporting the divider 10 independently of the trash can 12. Thus, each divider 10 is capable of standing alone free of the trash can 12 and other dividers 10. This feature is advantageous, for example, in permitting the divider 10 to be stacked together and stored freestanding when not in use, or to set one divider 10 out for emptying if the other dividers 10 are not full.

Although conceived as a means to separate and store recyclable materials, the present dividers 10 may be used for other purposes where separation of different materials is desired. For example, they could be used to separate clothing prior to doing laundry, or used in a manufacturing facility to separate and organize products.

The trash can dividers 10 are preferably formed from injection-molded thermoplastics, but other suitable materials and manufacturing methods known to those of skill in the art may also be used.

The preferred embodiments of the invention have been described. It should be appreciated that the invention is not limited to the embodiments disclosed, but is intended to embrace any alternative, modifications, rearrangements, or substitutions of parts or elements which fall within the spirit and scope of the invention.

I claim:

1. A trash can divider for dividing a trash can into compartments, said divider comprising:

a first wall conforming to a portion of an inner surface of the trash can; and a second wall and a third wall connecting to opposing edges of the first wall and projecting into an interior of the trash can;

wherein upon placement of a plurality of dividers into a single trash can, the dividers;

cooperate to define an aperture proximate the center of the trash can, the aperture having a diameter sufficient to receive an aluminum can, and cooperate with an inner surface of the trash can to define a volume in the bottom of the trash can; and wherein said divider has a length from a top edge to a bottom edge shorter than the height of the trash can, such that upon placement of a plurality of dividers into a single trash can, the dividers cooperate with a second inner surface of the trash can to define a volume.

2. The trash can divider of claim 1, further comprising a lip portion for supporting the divider on a top edge of the trash can.

3. The trash can divider of claim 1, wherein the plurality of trash can dividers define a top ridge for receiving a cover.

4. The trash can divider of claim 3, wherein the top ridge for receiving a cover is configured to receive a cover which may also be received by the trash can alone.

5. The trash can divider of claim 1, wherein the divider is tapered so that a plurality of dividers may nest together.

6. The trash can divider of claim 5, wherein each divider includes a handle configured for supporting each successive divider on a top ridge of the divider into which it rests.

7. The trash can divider of claim 1, wherein the first wall is connected by right angles to the second and third walls; and a fourth wall is connected to the second and third walls opposite the first wall to define a divider having a rectangular horizontal cross-section.

8. A trash can divider system for dividing a trash can into separate compartments, said divider system comprising:

a trash can; and a plurality of identical molded one piece dividers, each of said dividers comprising a first wall conforming to a portion of an inner surface of the trash can, a second wall and a third wall connecting to opposing edges of the first wall and projecting into an interior of the trash can, a bottom support surface for supporting the divider independently of the trash can, and a lip portion for supporting the divider on a top edge of the trash can;

said plurality of identical one piece dividers having a length from a top edge to bottom edge shorter than the height of the trash can, such that when the dividers are placed within the garbage can they cooperate with a second inner surface of the trash can to define a volume in the bottom of the trash can; and said plurality of identical one piece dividers further cooperating to define an aperture proximate the center of the trash can and in communication with the volume in the bottom of the trash can.

9. The trash can divider system of claim 8, wherein the trash can has a generally cylindrical shape.

10. The trash can divider system of claim 8, wherein the plurality of identical molded one piece dividers define a top ridge for receiving a cover.

11. The trash can divider system of claim 10, wherein the top ridge for receiving a cover is configured to receive a cover which may also be received by the trash can alone.

12. The trash can divider system of claim 8, wherein each of the identical molded one piece dividers is tapered so that a plurality of dividers may nest together.

13. The trash can divider system of claim 12, wherein each of the identical molded one piece dividers includes a handle configured for supporting each successive divider on a top ridge of the divider into which it nests.

14. The trash can divider system of claim 13, wherein the handle is configured to facilitate removal of the trash can divider from the trash can.

* * * * *